US006231686B1

(12) United States Patent
Eierman

(10) Patent No.: US 6,231,686 B1
(45) Date of Patent: May 15, 2001

(54) FORMABILITY OF METAL HAVING A ZINC LAYER

(75) Inventor: George R. Eierman, Lyndhurst, OH (US)

(73) Assignee: LTV Steel Company, Inc.

( * ) Notice: Subject to any disclaimer, the term of this patent is extended or adjusted under 35 U.S.C. 154(b) by 0 days.

(21) Appl. No.: 09/153,759

(22) Filed: Sep. 15, 1998

Related U.S. Application Data

(60) Provisional application No. 60/065,047, filed on Nov. 10, 1997.

(51) Int. Cl.[7] ..... C23C 22/00

(52) U.S. Cl. ..... 148/243; 148/246; 427/343; 427/406

(58) Field of Search ..... 148/240, 243, 148/246, 254; 427/156, 343, 406, 427, 435; 252/103.16

(56) References Cited

U.S. PATENT DOCUMENTS

| | | | | |
|---|---|---|---|---|
| 2,077,450 | | 4/1937 | Weisberg et al. . | |
| 2,132,584 | | 10/1938 | Speller . | |
| 2,148,331 | | 2/1939 | Weisberg et al. . | |
| 2,369,569 | | 2/1945 | Millen . | |
| 3,011,862 | | 12/1961 | Watkins . | |
| 3,046,165 | | 7/1962 | Halversen et al. . | |
| 5,236,574 | * | 8/1993 | Oshima et al. | 205/138 |
| 5,322,741 | * | 6/1994 | Uesugi et al. | 428/653 |
| 5,660,707 | | 8/1997 | Shastry et al. . | |

OTHER PUBLICATIONS

"ASM Handbook, vol. 13: Corrosion", ASM International Handbook Committee, 1987, pp. 383–388.*

"ASM Handbook, vol. 18: Friction, Lubrication, and Wear Technology", ASM International Handbook Committee, 1987, pp. 98–99.*

Fifty–five page Internal Report, "L–SE/L–S II GM Kalamazoo Trial Investigations", No. GMJ–1761, Dr. R. H. Goodenow, Mar. 18, 1993.

Twenty–three page Automotive Steel Design Manual, section, 4.1–4.12, published by the American Iron and Steel Institute, copyright 1986.

Twenty–three page Internal Report, "Draw Bead Simulation Friction Coefficient of L–SE Product. GM–Kalamazoo", No.: GMJ–1648, Dec. 1992.

* cited by examiner

*Primary Examiner*—John Sheehan
*Assistant Examiner*—Andrew L. Oltmans
(74) *Attorney, Agent, or Firm*—Watts Hoffman Fisher & Heinke

(57) ABSTRACT

A method of treating a metal object having an outer layer including zinc includes applying to the object a treating material in the form of an alkaline solution or a gas. The treating material reacts to form a reaction layer on the outer layer. The reaction layer includes a zinc reaction product. A protective coating such as lubricant is applied to the object, wherein the reaction layer is present in an amount effective to increase a lubricity of the object. In another embodiment the metal object includes an outer layer including zinc which may be substantially non-oxidized. A reaction layer comprising zinc carbonate is disposed on the outer layer. The reaction layer is present in an amount effective to increase a lubricity of the object during a forming process. A protective coating may be in contact with the reaction layer.

17 Claims, 3 Drawing Sheets

FORMABILITY OF METAL HAVING A ZINC LAYER

This application claims benefit of provisional application No. 60/065,047, filed Nov. 11, 1997.

FIELD OF THE INVENTION

The present invention relates to treating a metal object having a zinc layer and, in particular, to treating galvanized steel strip to improve its stampability.

BACKGROUND OF THE INVENTION

Metals are often coated to prevent corrosion. Corrosion of steel strips may be inhibited by applying an outer layer of zinc to the strips. The zinc layer is applied by a hot dip galvanizing or electrogalvanizing process, for example. After the zinc layer has been applied to the steel strip, the strip is subjected to a forming process such as stamping. In preparation for the forming process, the strip may be coated with a lubricant such as oil.

Lubricant may be applied prior to or during different stages of the forming process and may be applied by any number of techniques known in the art including electrostatically, by gravity and by "squeegee." One example of a lubricant that is applied to the steel is referred to as mill oil. Mill oil, which is primarily a rust preventative, is applied at the galvanizing facility to the uncoated galvanized steel prior to coiling. Another lubricant referred to as prelube may be applied by the galvanizing facility to the uncoated galvanized steel. Prelube provides both rust prevention and lubricity to the galvanized steel and is used when more difficult forming is to be carried out. At a stamping plant the steel may be subjected to blanking and the mill oil may be washed off by a blank washer. At the blank washer another lubricant may be applied to the uncoated product. Some stamping lines may stamp the product without applying any lubricant other than the mill oil. Any of the above lubricants may be present on the strip as the strip enters the stamping line and a drawing lubricant may be applied at a press.

During stamping, the steel strip is placed between an upper punch and a lower die of a press where it is held in place and formed into a desired shape. Articles such as automobile hoods and fenders may be formed in this manner. After forming, the article is passed through a bath containing an alkaline cleanser for removing the oil. The article may then be assembled, coated with a phosphate painting preparation and painted.

One factor that is important to the stamping process is the formability of the steel. A metal draw bead may be located adjacent to the die opening for retarding travel of the strip or blank as it is pushed into the die. The amount of frictional resistance at the interfaces between the punch, die and blank is an important factor in the quality of the formed article. Areas of both low and high strip-to-draw-bead speeds may occur during forming. It is desirable for the blank to exhibit a coefficient of friction with as little variation across low and high strip-to-draw bead speeds as possible. The high speed areas may result in a "hydroplaning" effect at a low frictional resistance whereas the low speed areas may suffer from slip stick. Slip stick is a phenomenon that occurs when two metals contact each other at slow relative speeds and high frictional resistance. In effect, a repeated cold welding and breaking-free of the metals occurs during slip stick. Notwithstanding proper die set up and punch operation, if there is excessive frictional resistance during forming, portions of the strip may tear or break, resulting in decreased quality or scrapping of the steel products.

SUMMARY OF THE INVENTION

The present invention is directed to a method of treating a metal object having an outer layer comprised of zinc and, in particular, to treating a galvanized steel strip. Although it is preferred that the object be a strip, any metal object having a coating of zinc that may benefit from improved lubricity may be treated in accordance with the present invention. In its broad aspects, the method includes the step of applying a treating material to the object. The treating material is reacted with the zinc outer layer to form a reaction layer on the outer layer. The reaction layer is comprised of a zinc reaction product, preferably a zinc carbonate compound, even more preferably, a compound known as basic zinc carbonate. The reaction layer is preferably in crystalline form. The reaction layer is present in an amount effective to increase a lubricity of the object, such as during the forming process. A protective coating such as a rust preventative or a lubricant (e.g., oil) is preferably applied to the object. During stamping, the objects exhibit increased lubricity compared to objects having a protective coating but not the reaction layer. This avoids problems such as tearing of the objects during stamping.

A preferred aspect of the invention is directed to using a treating material in the form of a solution comprising a bicarbonate compound. In particular, the solution may be formed by combining a solvent and a bicarbonate or a salt thereof, for example an alkali metal bicarbonate compound. The alkali metal is selected from the group consisting of sodium, potassium and lithium. The treating material may be free of an oxidizing agent, but an oxidizing agent may be used to achieve consistent coverage uniformity, particularly when the metal objects have been oiled and left for an extended period of time.

The time of reaction, temperature of the treating solution and concentration of reactants, are variables that may be adjusted empirically to produce the desired amount of the reaction layer. The treating material is at a temperature not greater than about 100° C. when applied to the object, and may advantageously be applied at about room temperature. The treating solution may be applied by immersing the objects in the solution, spraying, using rollers, or flowing the solution onto the objects. The zinc carbonate compound may also be formed by applying a gaseous treating material to the zinc outer layer. One such suitable treating material comprises carbon dioxide and acetic acid gases.

The treatment time may vary depending upon the intended amount of the reaction layer as well as the method of application. It is preferable to treat metal objects, e.g., steel strips, that have zinc freshly plated on them, since oxidation of the zinc outer layer may inhibit application of the treating material. To this end, in all methods of application it is preferable to treat the objects within 24 hours from when the zinc outer layer has been applied by galvanizing. It is more preferable to treat the objects within about 5 minutes, even more preferably, within about 1 minute, after the zinc outer layer has been applied. Each object is then formed into a shaped article at a reduced frictional resistance compared to an object with a protective coating but not the reaction layer. A ratio of change in coefficient of friction to change in draw bead pulling speed is not greater than about $2.9\times10^{-4}$ and, more preferably, not greater than $5\times10^{-5}$, at pulling speeds of 1 and 200 inches/minute. The protective coating, e.g., lubricant, and the reaction layer are then removed from the object after forming. The reaction layer may be removed from the object using an acidic phosphate solution. The article may later be painted.

Another preferred embodiment is directed to a method including the steps of applying to the strip the treating solution comprising the bicarbonate compound. The bicarbonate and the zinc of the outer layer react to form the reaction layer on the outer layer. Lubricant is applied to the strip. The strip is formed into an article of a desired shape by a forming process. The reaction layer is present in an amount effective to increase a lubricity of the strip during the forming process. The treating solution may further comprise an oxidizing agent selected from the group consisting of a peroxide, persulfate and percarbonate compound. A phosphate solution is applied to the strip after the forming process for preparing the strip for painting. The reaction layer may be removed from the strip with the phosphate solution.

The invention is also directed to a metal object having improved formability comprising a body comprised of metal, such as a steel strip, and an outer layer of zinc disposed on the body. The outer layer is selected from the group consisting of a layer comprising about 98% zinc by weight, a layer comprising zinc and about 12% by weight nickel and a layer comprising zinc and about 10% by weight iron. In each of the above layers, zinc is present in a major amount. The outer layer is preferably substantially non-oxidized. A reaction layer of zinc carbonate is disposed on the outer layer. The reaction layer is present in an amount effective to increase a lubricity of the object during the forming process. The reaction layer may be in crystalline form. A protective coating such as lubricant may be in contact with the reaction layer.

An important aspect of the present invention is that the treating solution improves the forming characteristics of steel strips. Typically, steel strips are subjected to a phosphate solution after forming in preparation for painting. Oil is conventionally removed from the strips prior to the application of the phosphate solution. The reaction layer of the present invention and added lubricant improve the lubricity of the steel strips during forming before any phosphate solution is applied. This improved lubricity enables the strips to be formed with less friction and avoids problems during stamping such as tearing of the strips.

Many additional features, advantages and a fuller understanding of the invention will be had from the accompanying drawings and the detailed description that follows.

DETAILED DESCRIPTION OF PREFERRED EMBODIMENTS

Figure 1:
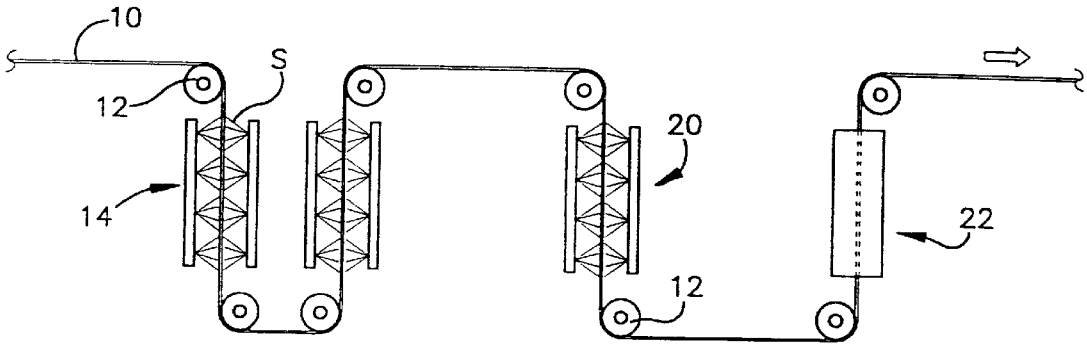
FIGS. 1–3 show application of the treating material in accordance with the present invention.

A preferred form of the present invention is directed to a method of treating galvanized steel strip. A zinc outer layer is applied to the steel strip by an electrogalvanizing or hot dip galvanizing process. A treating material reacts with the zinc of the outer layer to form a reaction layer comprising a zinc reaction product. The treating material is applied to the strip such as by spraying, immersion, roll coating or otherwise flowing the solution onto the strip and the like, or any combination thereof. Lubricant applied to the strip in contact with the reaction layer improves the lubricity of the strip, which avoids tearing of the strip during forming.

The treating material is a solution, preferably aqueous, which contains bicarbonate ions $(HCO_3)^-$. The treating material is preferably an aqueous solution of bicarbonate salt, more preferably, an aqueous solution of an alkali metal bicarbonate compound. The alkali metal is preferably sodium or potassium, although lithium may also be suitable. The chemical formulas for sodium bicarbonate and potassium bicarbonate are $NaHCO_3$ and $KHCO_3$ and the chemical formula for bicarbonate is $H_2CO_3$. A solution of ammonium bicarbonate $(NH_4HCO_3)$ may also be a suitable treating material. While not wanting to be bound by theory, carbonates alone as opposed to bicarbonates are not believed to result in the improved properties of the present invention. A zinc carbonate reaction layer is formed by reaction of the bicarbonate compound and the zinc outer layer. While not wanting to be bound by theory as to the exact chemical composition formed it is believed that the bicarbonate ions of the treating solution react with zinc of the outer layer to form the zinc carbonate reaction layer.

The properties of the present invention may advantageously be achieved even without the use of an oxidizing agent. An oxidizing agent may not be needed when treating the strip shortly after the galvanizing process when the zinc is still fresh (for example, less than 24 hours after plating). However, an oxidizing agent may be used to reliably produce the reaction layer, particularly when treating steel strip that has been oiled and stored for a length of time. Applying a treating material including oxidizing agent avoids areas of poor reactivity and may result in a more even coating on the strip. Suitable oxidizing agents include peroxide, permanganate, persulfate and percarbonate compounds. Examples of these compounds include hydrogen peroxide $(H_2O_2)$, potassium permanganate, sodium percarbonate, potassium percarbonate, sodium persulfate, ammonium persulfate, and potassium persulfate. Oxidizing agents may be used in an amount ranging from ½ to 5% by weight based upon the weight of the aqueous solution of bicarbonate compound. The oxidizing agent (e.g., $H_2O_2$, 30% by weight in water) is preferably added to the bicarbonate solution in an amount ranging from 0 to about 5 g/l. The treating solution with oxidizing agent is effectively buffered by the presence of the bicarbonate compound.

The pH of the treating solution preferably ranges from about 6 to about 9 and, in particular, is at least about 7. It is undesirable for the treating solution to be too acidic. Although not wanting to be bound by theory, at a pH less than about 6, carbonic acid may dissolve the zinc carbonate. On the other hand, carbonates are too alkaline and do not form the zinc carbonate compound. At a pH of about 11 to 12 soluble sodium zincate $(Na[Zn(OH)_3])$ is believed to be formed and is undesirable.

In aqueous solution, sodium bicarbonate has a pH that ranges from about 7.3 at a concentration of 1 g/l to a pH of about 7.8 at a concentration of 50 g/l. Lithium bicarbonate has a pH that ranges from about 7.3 at a concentration of 5 g/l to a pH of about 7.9 at a concentration of 20 g/l. Potassium bicarbonate has a pH ranging from 8.6 to 8.7 at concentrations ranging from 5 g/l to 100 g/l. Ammonium bicarbonate has a pH ranging from about 7.6 to about 7.7 at concentrations ranging from 5 g/l to 100 g/l.

The amount of the reaction layer is determined by factors including the reaction time during which the treating material is in contact with the zinc outer layer. The treating material is preferably in contact with the zinc outer layer for at least about 7 seconds and preferably, for at least about 10 seconds. The amount of the reaction layer may range from 10 mg/m$^2$ to about 100 mg/m$^2$, for example. The reaction time should be selected to produce the desired amount of the reaction layer and in view of time constraints due to the arrangement and type of equipment in the existing processing line. The treating solution is rinsed off after application to prevent long exposure to bicarbonate salts from adversely affecting the strips.

Temperature is another factor that influences the thickness of the layer. The treating material is preferably at room temperature when it reacts with the outer layer. However, reaction times may be decreased when the treating material is at higher temperatures up to about 100° C. Concentration of the components of the treating solution is also a factor that influences the reaction rate. The alkali bicarbonate and ammonium bicarbonate may be present in aqueous solution in an amount ranging from about 1 g/l to about 150 g/l, in particular, from 1 g/l to 125 g/l and, more particularly, from about 5 g/l to about 75 g/l (the bicarbonate being applied in granular form per liter of water). A preferable concentration of the bicarbonate compound in aqueous solution is at least about 50–75 g/l.

Thickeners and surface control agents known to those skilled in the art may also be used to control flow and coverage uniformity. A thickener and surface control agent may be added when the application is by roll coating or flowing the solution onto the strips, but is optional when the treating solution is applied by immersing the strips in a bath of the solution or when the zinc plating is still fresh.

Any suitable thickener and surfactant known to those skilled in the art may be employed. Some examples of thickeners that may be used comprise the following; hydroxyethyl cellulose, hydroxypropyl cellulose, methyl cellulose, agar agar, algenates and xanthan gum. Surfactants may result in improved spreading of the treating material during roll coating by lowering the surface tension. Examples of nonionic surfactants that may be used are Triton CF-32 and Triton X-100 by Union Carbide Corp. An example of a suitable anionic surfactant that may be used is Triton X-200 by Union Carbide Corp.

The strips may have any suitable steel composition. Steel that may be suitable for galvanizing and subsequent forming generally has the following composition in % by weight: under 0.20% C, under 1.70% Mn, under 0.12% P, under 0.04% S, under 1.4% Si, under 0.25% Cr, 0.005/0.012% Al, under 0.020% N, under 0.12% V, under 0.12% Ti, under 0.10% Cb, under 0.010% Ca, and under 0.012% B, with the balance being iron and unavoidable impurities. Strip thickness may range from about 15 to about 125 thousandths of an inch, for example.

The outer layer is preferably comprised of about 98% zinc by weight. Using a zinc outer layer of such a high purity is believed to produce better results than zinc alloys such as hot dip galvaneel steel. However, strips comprised of various zinc alloys may be treated according to the present invention including zinc-iron alloy (e.g., comprising zinc and about 10% by weight iron), zinc-aluminum alloy, zinc-nickel alloy (e.g., comprising zinc and about 12% by weight nickel) and zinc-cobalt alloy. Zinc is present in major amount in each of the above alloys. The amount of the zinc layer on the strip may range from about 15 to about 120 g/m$^2$, for example, and is typically present in an amount of about 60 g/m$^2$.

The reaction layer is present in an amount which retains an increased amount of lubricant effective to improve the lubricity of the strip. For example, the amount of the reaction layer advantageously provides a lubricated strip with at least a 15% decrease in the average coefficient of friction with respect to a draw bead in contact with the strip at a relative strip-to-draw-bead speed of 200 inches per minute compared to as-produced zinc galvanized strip with lubricant. The reduced frictional resistance may reduce ram forces and may also result in reduced tearing of the strip during stamping.

The strips contain any suitable lubricant known to those skilled in the art. A preferred lubricant is oil. The lubricant that is present on the strip may be mill oil, e.g., Quaker Ferrocoat 61AUS. A suitable prelube is Fuchs 7105A. Quaker 59M or 57M may be applied at the press or the blank washer. The reaction layer may enable the strips to exhibit improved lubricity when any lubricant or combination of lubricants is applied.

Figure 2:
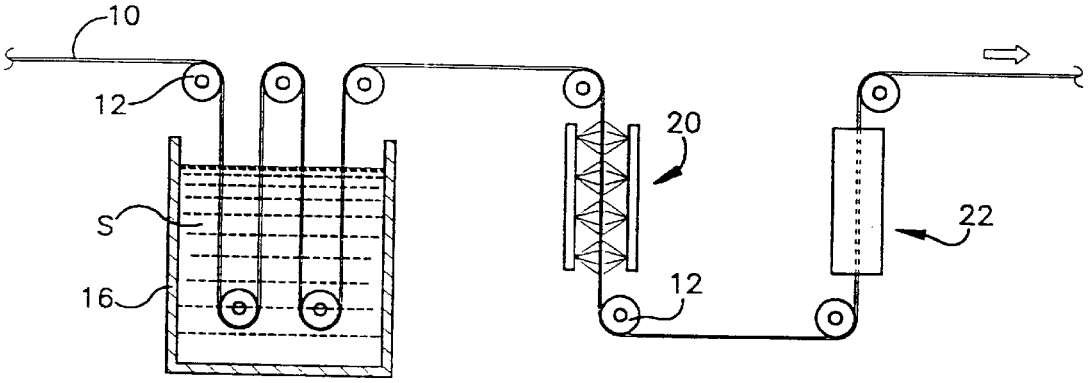
Figure 3:
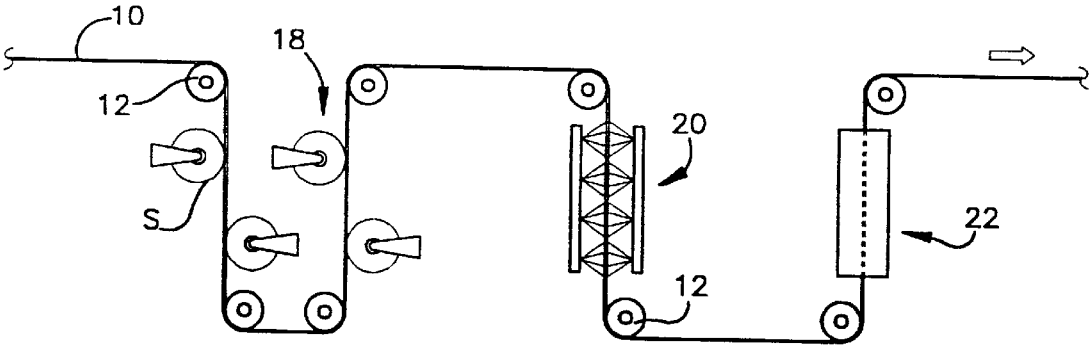

Referring now to the the drawings, FIGS. 1–3 show examples of apparatuses for applying the treating solution S to the strip by spraying, immersion and roll coating, respectively. The apparatuses are preferably located immediately down-line from the galvanizing process. In these Figures like reference numerals are used to designate like components of the process. In the spraying process shown in FIG. 1 the strip 10 is directed by rollers 12 through a spraying station 14. Those skilled in the art will recognize in view of this disclosure additional or substitute apparatuses that are suitable for use in the present invention as well as directions of strip travel during application, rinsing and drying of the treating solution other than what is shown and described herein.

As shown in FIG. 2, the treating solution is preferably applied to the strip by immersing the strip 10 into a tank 16 of the treating solution S. If electrogalvanized strips are coated by immersion, the tank 16 that is used is preferably an existing rinse tank located immediately downstream of the galvanizing line. Such an existing rinse tank may contain other additives known to those skilled in the art such as compounds for adjusting the pH of the rinse water. A plurality of baffles which separate the tank into sections may be disposed in the tank as in known rinse tanks to impede flow of liquid in the direction of strip travel. Rinse water such as city or process water flows into the tank opposite the direction of strip travel. Electrogalvanized strips leave the line with an acidic electrolyte on them. Therefore, the water of the rinse tank, e.g., tank 16, is progressively less acidic as the strip travels through the tank to the far end near the fresh water inlet. The treating solution may be introduced at the last section of the tank at the fresh water inlet where the pH is normally in the range of about 7–8. The last section of the tank would preferably be maintained at a pH of about 8 or greater. The treating time in the rinse tank may be about 5–10 seconds, for example. Bicarbonate salt in granular form may be added to the tank in an amount ranging from 1 to about 150 g/l of bath.

The treating solution may also be applied by rollers as represented generally by rollers 18 in FIG. 3. A back-up roll, applicator roll and pick-up roll may be used as known in the art. The applicator roll may be comprised of rubber and contacts the strip while rotating in a direction opposite to the direction of strip travel. In contact with the applicator roll is a pick-up roll which rotates in the same direction as the applicator roll. The pick-up roll is textured and picks up the treating solution and transfers it to the applicator roll which, in turn, transfers it to the strip. The amount of the coating that is applied is influenced by factors including the speed ratio of the pick-up roll to the applicator roll and the ratio of the applicator roll speed to the strip speed.

Thickeners and surfactants may be added to the treating solution for application by roll coating. However, when the zinc has been freshly plated onto the steel the surface may be wetted evenly by the treating solution even without the use of thickeners and surfactants. Thickeners and surfactants are not needed using the immersion application process. During the application, rinsing and drying of the treating material the strips may travel at a speed of about 250 to 600 feet/minute. The residence time of the treating solution applied to the strip by roll coating may be about 4 minutes, for example.

After application of the treating solution as shown in FIGS. 1–3, the strips are rinsed at a rinse station 20. When roll coating or spraying, the strips may still be sent through a rinse immediately after zinc plating, as is conventional, although this rinse only comprises water, not treating solution. However, immersion coating may be used in conjunction with the roller or spraying application to apply the treating solution in the same process. Only a small amount of the treating solution that has contacted the strip is used in the formation of the reaction product. It is undesirable to allow bicarbonate compounds to dry on the strip. Soluble salts are rinsed off, leaving insoluble zinc carbonate on the strips. Excess treating solution is blown off with pressurized heated or unheated air at a drying station 22.

Figure 4:
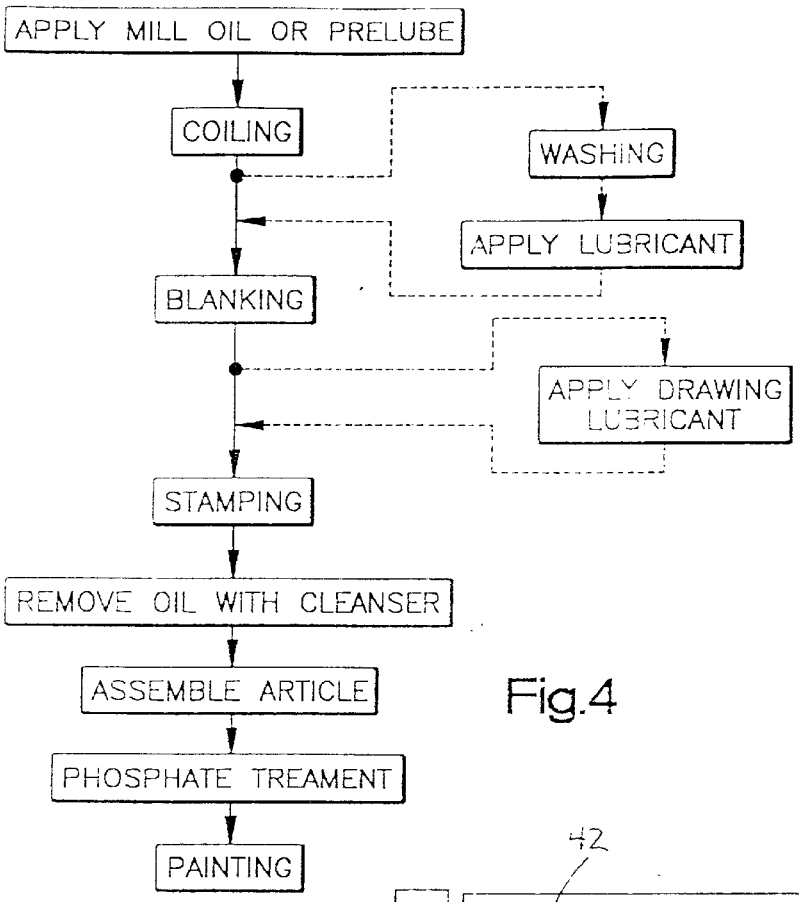
FIG. 4 is a flow chart generally depicting a forming process for steel strip that may be employed in the present invention.

Referring to FIG. 4, after leaving the drying station 22 mill oil or prelube is applied to the strip and the strip is then coiled. At this point, the coils may be transported to another location for storage or forming. In one variation, at the stamping plant the coils are placed on a mandrel and the head end of the coil is fed into a washer. At the washer the mill oil is washed off and a lubricant is applied to both sides of the strip. It will be appreciated that throughout this disclosure the treating solution and lubricant may be applied to one or both sides of the strip. Brushes may be used to wash the surface and rubber rolls may be used to squeegee off excess oil at this stage and in all oil application and washing operations described herein. The steel is then blanked or cut to a desired size. At the stamping press line each blank is coated with a drawing lubricant in anticipation of punching. Other types and combinations of lubricants may be applied and removed at various steps of the forming process.

Figure 5:
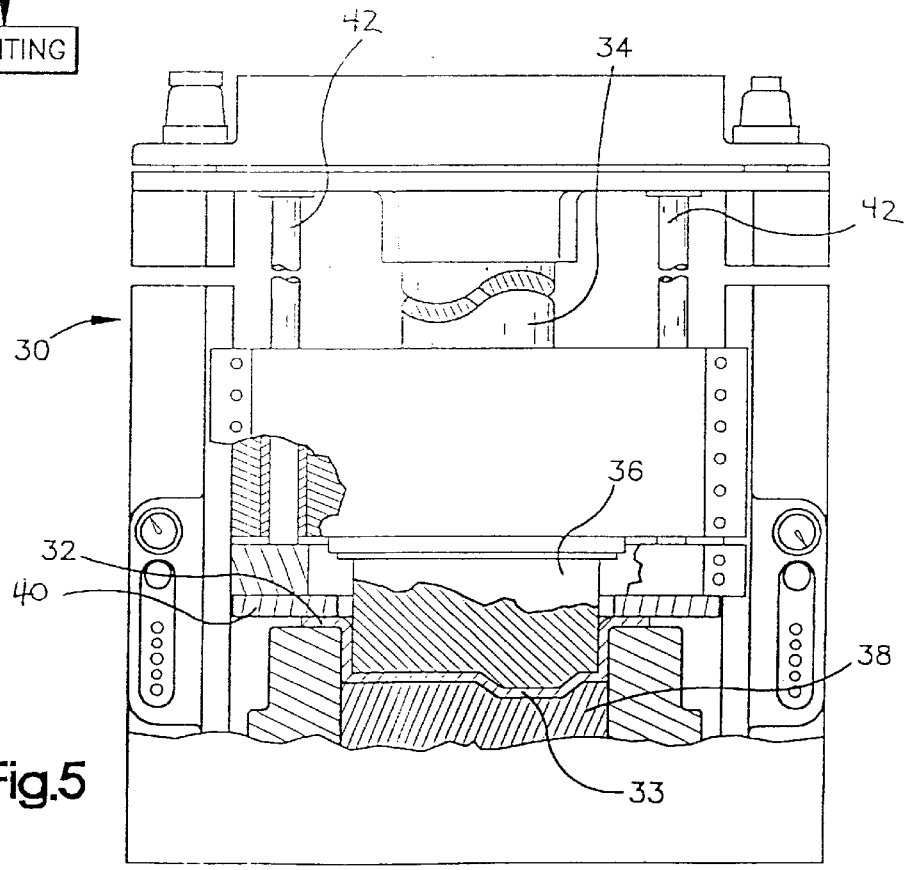
FIG. 5 is a front elevational view in partial section of a stamping press that may be used in the present invention.

FIG. 5 shows one example of a hydraulic press 30 that is suitable for forming a blank or strip 32 of steel into a shaped article, a portion of which is shown at 33. The press includes a main ram 34 that moves a punch 36 toward a die 38. The die and punch have particular shapes for attaining the desired shape of the article. A blank (a portion of which is shown at 32) is positioned over the die and held in place by a blank holder 40. The blank holder is moved by rams 42. The punch contacts the blank and moves it into the die to form it into the desired shape. In this regard, a publication entitled, *Automotive Steel Design Manual,* American Iron and Steel Institute, First Edition 1986, is incorporated herein by reference (see pages 4.1-1 through 4.1-12). While the particular punching operation shown in FIG. 5 benefits from increased lubricity of the strips, those skilled in the art would appreciate in view of this disclosure and the AISI publication that other forming operations may also benefit from strips having increased lubricity.

Referring again to FIG. 4, after stamping the blank into an article of desired shape the article is immersed in a tank of an alkaline cleanser, which emulsifies the oil on the article for removal. The article is then assembled and treated with a suitable phosphate solution known to those skilled in the art in preparation for painting. The phosphate solution, being acidic, may remove the treating solution from the article. The article may then be painted.

The invention will now be described by reference to the following nonlimiting examples.

EXAMPLE 1

One example of a strip suitable for zinc electrogalvanizing had the following steel composition, in % by weight: 0.015% C, 0.21% Mn, 0.008% P, 0.010% S, 0.013% Si, 0.19% Cr, 0.035% Al, 0.003% Ti, under 0.002% Cb, 0.013% Cu, 0.007% $N_2$ and 0.003% $O_2$, with the balance being iron and unavoidable impurities. A steel strip having this or another suitable composition is plated with a zinc layer. One example of a composition of a zinc layer electrogalvanized onto steel strip is as follows, in % by weight: 0.12% Fe, 0.001% Ni, under 0.001% Sb, 0.001% Pb, 0.001% Al, 0.001% Cu, under 0.001% Sn, under 0.001% Cd and under 0.001% Co, with the balance being zinc. Those skilled in the art will appreciate in view of this disclosure that the composition of the zinc outer layer may vary such as near the steel strip.

The treating solution is applied directly to the "virgin" zinc plated steel strip by immersion, roll coating or spraying. The virgin galvanized steel strip contains no lubricants. After application of the treating solution, the strip may be rinsed and blown with air. At this point either a mill oil or a prelube is applied to the strip and the strip is coiled. In one variation, at the stamping plant the coils are placed on a mandrel and the head end of the coil is fed into a washer. At the washer the mill oil is washed off and a lubricant, e.g., Quaker Draw 61-Z2-M, is applied to both sides of the steel. Brushes are used to wash the surface and rubber rolls are used to squeegee off excess oil. Immediately after the washer the steel is blanked, for example, to 108 inches long by 60 inches wide. At the stamping press line each blank is lifted by suction cups, processed through a set of small rolls to coat the steel with a drawing lubricant, e.g., Quaker Draw 58-E9, and placed in a press for the forming operation.

After forming into an article of desired shape, e.g., an automobile bumper, the article is immersed in a tank comprising an alkaline cleanser, e.g., Parker+Amchem E C-76, which emulsifies the oil on the article for removal. The article is then assembled, e.g., the bumper is welded to an automobile frame along with doors, quarter panels and other components, and is then treated with a suitable phosphate solution known to those skilled in the art in preparation for painting. One example of a phosphate solution that may be applied to the strips is Chemfil 700 by Pittsburgh Plate Glass. The phosphate solution is acidic and may remove the treating solution from the article. The article is then painted.

EXAMPLES 2 and 3

To prepare a treating solution, granular sodium bicarbonate was added to deionized water in an amount of 75 grams/liter (g/l) and heated to 120° F. Added to this was 80 milliliters (ml) of 30% by weight aqueous $H_2O_2$ as an oxidizing agent. In these examples the sodium bicarbonate and hydrogen peroxide were analytical reagent grade, obtained from Fisher Scientific Co. To this solution was added 0.01% by weight Zonyl FSN, a fluorocarbon surfactant. Electrogalvanized steel strips L-S11 1763051 were cleaned in a vapor degreaser and baked in a gas oven for 2 hours at 300° F. Each strip had dimensions of about 2×16 inches. Strips were immersed in the treating solution for 7 seconds (Example 2) and 60 seconds (Example 3), respectively. A reaction layer comprising a zinc carbonate compound formed on the zinc outer layer of the strips, and the reaction layer was in crystalline form.

EXAMPLES 4 and 5

To prepare a treating solution, 380 grams of a 2% by weight aqueous solution of sodium persulfate were dissolved in 5 gallons of deionized water. To this solution was added 75 g/l of sodium bicarbonate. The 2×16 inch strips were degreased as in Examples 2 and 3 without baking. The strips were immersed in the treating solution for 5 seconds (Example 4) and 20 seconds (Example 5), respectively. The strips were rinsed in deionized water and warm air dried. A reaction layer comprising a zinc carbonate compound formed on the zinc outer layer of the strips and the reaction layer was in crystalline form. Baking the strips of Examples 2 and 3 before applying the treating solution produced a more uniform coating than in Examples 4 and 5.

The following Table 1 shows the average coefficient of friction $\mu$ resulting from a draw bead simulator test in which Quaker Ferrocote 61A-US oil was applied to electrogalvanized steel strips. The draw bead test simulated die punching.

TABLE 1

| | Average Coefficient of Friction $\mu$ | | | | |
|---|---|---|---|---|---|
| Speed (inch/minute) | As-Produced | Example 2 | Example 3 | Example 4 | Example 5 |
| 200 | 0.118 | 0.100 | 0.080 | 0.111 | 0.108 |
| 10 | 0.206* | 0.143 | 0.097 | 0.188* | 0.182* |
| 1 | 0.214 | 0.158 | 0.090 | 0.217* | 0.210* |

*Slip stick occurred

As Table 1 shows, the reaction layer of Example 2 was present in an amount that retained an increased amount of lubricant effective to provide the strip with at least about a 15% decrease in frictional resistance to the draw bead in contact with the strip, at a relative strip-to-draw-bead speed of 200 inches per minute, compared to the as-produced strip. The reaction layer of Example 3 was present in an amount that retained an increased amount of lubricant effective to provide the strip with at least about a 32% decrease in frictional resistance to the draw bead in contact with the strip, at the relative. strip-to-draw-bead speed of 200 inches per minute, compared to the as-produced strip.

Figure 6:
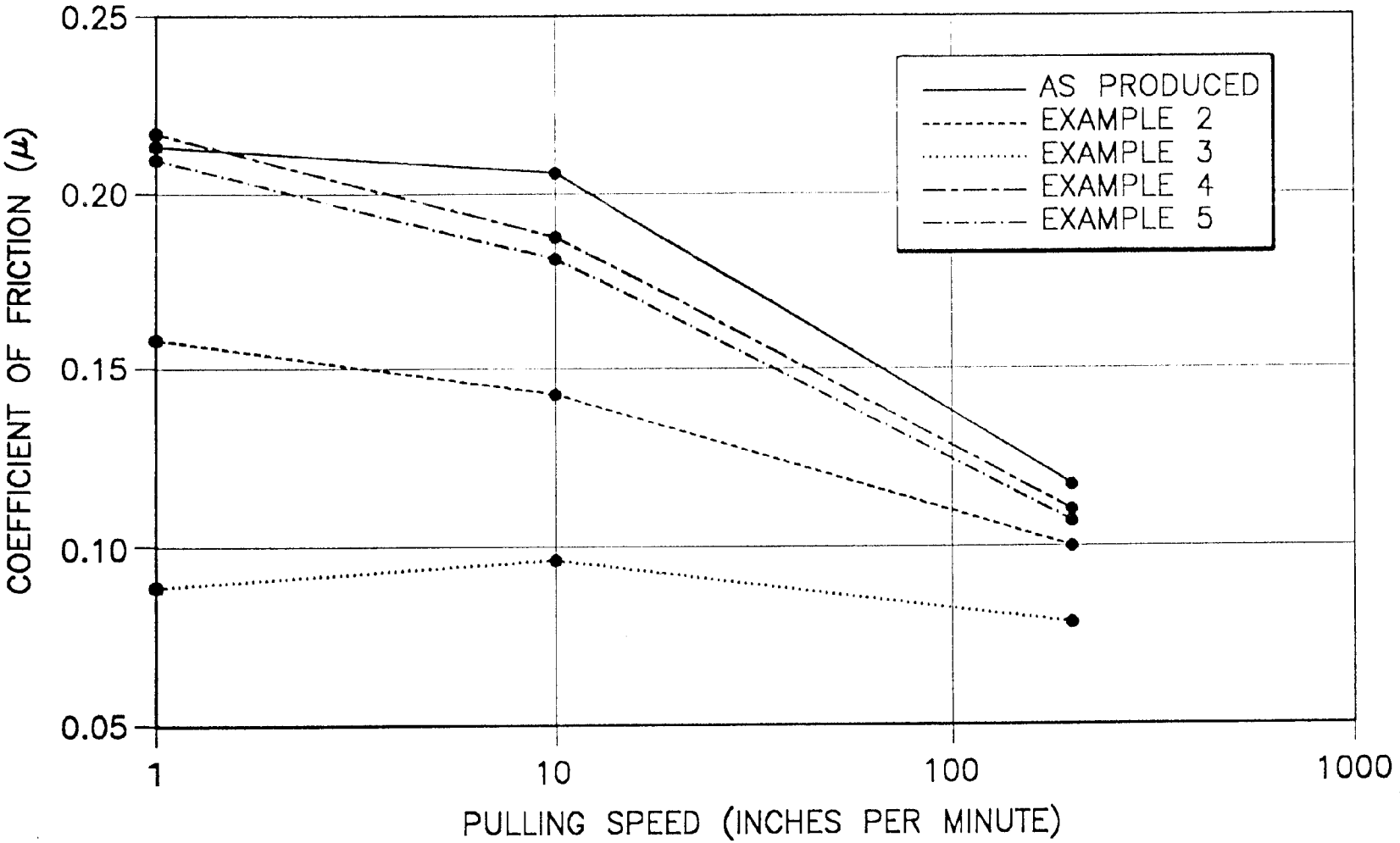
FIG. 6 shows the coefficient of friction $\mu$ as a function of pulling speed for electrogalvanized steel strips.

FIG. 6 shows the results of the draw bead simulator friction test and plots the data of Table 1. This figure shows that Example 3, which was treated for 60 seconds, exhibited an average friction coefficient that was lower than all of the other samples and much lower than the untreated as-produced strip. This sample also showed speed stability. That is, the sample showed a relatively uniform coefficient of friction across the entire range of pulling speeds evaluated.

The following compares the speed stabilities of the as-produced strip, Example 2 and Example 3. The following ratios are taken at pulling speeds of 1 and 200 inches/min. A ratio of change in coefficient of friction to change in draw bead pulling speed was about $4.8\times10^{-4}$ for the as-produced strip [(absolute value of 0.214–0.118)/ (absolute value of 200-1)]. A ratio of change in coefficient of friction to change in draw bead pulling speed was about $2.9\times10^{-4}$ for Example 2. A ratio of change in coefficient of friction to change in draw bead pulling speed was about $5.05\times10^{-5}$ for Example 3.

EXAMPLE 6

Treating solutions were prepared and applied to galvanized steel strips at various concentrations, times and temperatures as described in the following Table 2 to determine the effects of these conditions upon the formation of the Zn reaction layer.

TABLE 2

| Bicarb. Sol'n[1] (g/l) | Oxidizing Agent[2] | Exposure Time | Temp.[3] (° F.) | Comments |
|---|---|---|---|---|
| 100 | 5 drops/ 100 ml | 5 min. | | Dark strip[4] |
| 100 | 5 drops/ 100 ml | 10 sec. | | |
| 100 | 1 drop/ 100 ml | 5 min. | | Dark strip[4] |
| 100 | ½ drop/ 100 ml | 5 min. | | Dark strip[4] |
| 10 | 0.5 g/l | 5 min. | | |
| 50 | 20 drops/ l | 30 sec./ 120 sec. | | Zn Rxn. Layer |
| 10 | 0.5 ml | 5 min. | | Zn Rxn. Layer[5] |
| 10 | 1 ml/l | 10–240 sec. | 80, 140° F. | |
| 50 | 1 ml/l | 5, 30, 120, 300 sec. | 80° F. | Strips did not carbonate <120 sec. |
| 50, 75, 100 | 1 ml of 10% $H_2O_2$ | 5, 15 sec. | 160° F. | Zn Rxn. Layer |
| 75 | 15 g/l | 15 sec. | 120, 140, 160° F. | Zn Rxn. Layer[6] |
| 75 | 10 g/l[7] | 15 sec. | | Zn Rxn. Layer |
| 75 | 5 g/l | 10, 30 sec. 1, 4 min. | | Also added 15 g/l methyl cellulose[8] |

[1]Sodium bicarbonate in grams of granular compound per liter of water.
[2]Aqueous $H_2O_2$ (30% by weight), unless otherwise indicated. Proportion added is based upon the volume of bicarbonate solution.
[3]Room temperature unless otherwise indicated.
[4]The dark strips are believed to indicate the presence of the Zn reaction layer.
[5]In 60 mm flat bottom cup test, the Zn reaction layer decreased the load by an average of 5.2% (without lubricant) and 29.5% (with AUS lubricant), respectively, compared to untreated strip with no lubricant.
[6]The crystallinity or amount of Zn reaction layer increased as a function of temperature.
[7]Aqueous sodium persulfate (1% by weight).
[8]Simulated roll coating. Exposure for 1 and 4 minutes produced heavy Zn reaction product.

Table 2 shows that, in general, increasing the amount of oxidizing agent (e.g., $H_2O_2$) and reaction time resulted in a uniform and increased amount of the zinc reaction layer. Increasing temperature also increased the formation of the zinc reaction layer. A minimum concentration of sodium bicarbonate is preferably about 50 to about 75 g/l of water.

EXAMPLE 7

To determine the composition of the reaction layer formed on the zinc outer layer, a coupon of zinc plated steel was placed in a bottle of an aqueous solution of sodium bicarbonate having a concentration of 1 g/l for 1 month. A white crystalline compound formed on the reaction layer and the atomic composition was analyzed using a Jeol 6100 scanning electron microscope using energy dispersive X-ray analysis. The compound was a zinc carbonate compound (e.g., $2ZnCO_3 3Zn(OH)_2$), as confirmed by the reference, Farnsworth, Marie F. and Charles H. Kline, Zinc Chemicals, Zinc Institute Inc., 292 Madison Avenue, New York, N.Y. 10017, p. 132 (First Ed. 1973). This compound may be referred to as basic zinc carbonate.

It has been determined using scanning electron microscopy that the reaction layer comprises needle-like crystals or clusters of crystals. While not wanting to be bound by theory, it is believed that an increased amount of lubricant is retained by the crystalline microstructure of the reaction layer, leading to the improved lubricity of the strips. During the high forces exerted during stamping, lubricant is normally forced away from the strip, which may result in undesirable metal-to-metal contact between the die, punch and blank. In accordance with the invention, it is believed that the lubricant is retained in crevices formed by the zinc reaction compound. This retained lubricant may reduce instances of metal-to-metal contact, result in lower coefficients of friction during forming and result in reduced tearing.

EXAMPLE 8

The following treating solution was prepared to simulate roll coating. Added to 1–5% by weight aqueous sodium bicarbonate solution was 0.1% to 0.5% by weight of a methylcellulose thickener (1% aqueous solution at 4000 cps). Added to this was about 0.05% by weight Triton X-100 nonionic surfactant by Rohm and Haas. Strips of zinc galvanized steel were dipped and drained to simulate roll coating. The strips stood for about 3 to 4 minutes, were rinsed in water and dried with pressurized air. A zinc carbonate compound formed on the zinc outer layer of the strips and the reaction layer was in crystalline form.

EXAMPLE 9

The following experiment was conducted to simulate the treatment of strips freshly plated with zinc. Zinc was applied to steel strips. Several seconds later the strips were dipped into aqueous bicarbonate solutions ranging from 1 g/l to about 125 g/l alkali bicarbonate salt. No oxidizing agents were used. SEM analysis confirmed the formation of a reaction layer comprising a zinc carbonate compound on the strips and that the reaction layer was in crystalline form.

EXAMPLE 10

To form the reaction layer using gaseous treating compounds, a zinc plated strip was placed in a chamber with a towel soaked in 0.01 mol acetic acid. Carbon dioxide gas was pumped into the chamber. SEM analysis confirmed the formation of a reaction layer comprising a zinc carbonate compound on the strips and that the reaction layer was in crystalline form.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of improving the formability of steel strip having an outer layer comprised of zinc, comprising the steps of:

applying to the strip a treating solution comprising bicarbonate;

reacting said bicarbonate and the zinc of said outer layer effective to form a reaction layer on said outer layer, wherein said reaction layer comprises a zinc carbonate compound;

applying lubricant to the strip; and forming the strip into an article of a desired shape by a forming process, wherein said reaction layer is present in an amount effective to increase the lubricity of the strip during the forming process.

2. The method of claim 1 wherein said reaction layer is present in an amount effective to retain said lubricant to provide coefficient of friction uniformity characterized by a ratio of change in coefficient of friction, resulting from contact between a draw bead and the strip which includes said reaction layer and said lubricant, to change in draw bead pulling speed which is not greater than about $2.9\times10^{-4}$ at pulling speeds of 1 and 200 inches/minute.

3. The method of claim 1 wherein said reaction layer is present in an amount effective to retain said lubricant to provide coefficient of friction uniformity characterized by a ratio of change in coefficient of friction, resulting from contact between a draw bead and the strip which includes said reaction layer and said lubricant, to change in draw bead pulling speed which is not greater than about $5\times10^{-5}$ at pulling speeds of 1 and 200 inches/minute.

4. The method of claim 1 wherein said bicarbonate is selected from the group consisting of sodium bicarbonate, potassium bicarbonate, lithium bicarbonate and ammonium bicarbonate.

5. The method of claim 1 wherein said treating solution is at about room temperature when applied to the strip.

6. The method of claim 1 comprising applying said treating solution to the strip not greater than about 24 hours after the zinc outer layer is applied to the strip.

7. The method of claim 1 comprising applying said treating solution to the strip not greater than about 1 minute after the zinc outer layer is applied to the strip.

8. The method of claim 1 further comprising applying a phosphate containing solution to the strip after said forming step.

9. The method of claim 1 wherein said treating solution further comprises an oxidizing agent.

10. The method of claim 9 wherein said oxidizing agent is selected from the group consisting of a peroxide, persulfate and percarbonate compound.

11. The method of claim 8 further comprising removing said reaction layer from the strip with the phosphate solution.

12. The method of claim 1 wherein the outer layer of zinc is formed by an electrogalvanizing process.

13. The method of claim 1 wherein the outer layer of zinc is formed by a hot dip galvanizing process.

14. A method of treating a steel object having an outer layer comprised of zinc, comprising the steps of:

reacting a treating material with the outer layer effective to form a reaction layer on the outer layer, said reaction layer comprising zinc carbonate; and applying lubricant to the object comprising the reaction layer, wherein said reaction layer is present in an amount effective to increase the lubricity of the object.

15. A method of treating a steel object having an outer layer comprised of zinc, comprising the steps of:

reacting a treating material comprising gaseous carbon dioxide and acetic acid with the outer layer effective to form a reaction layer on the outer layer, said reaction layer comprising zinc carbonate; and applying lubricant to the object comprising the reaction layer, wherein said reaction layer is present in an amount effective to increase the lubricity of the object.

16. The method of claim 14 wherein said treating material comprises a solution of a bicarbonate compound.

17. A method of treating steel strip having an outer layer comprised of zinc, comprising the steps of:

applying to the strip a treating solution which comprises bicarbonate and is free from an oxidizing agent, wherein said treating solution is applied to the strip within a time that is not greater than about one minute from when said outer layer was formed on the strip; and reacting said bicarbonate and the zinc of said outer layer to form a reaction layer on said outer layer, wherein said reaction layer comprises a crystalline zinc carbonate compound.

* * * * *